US008430501B2

(12) United States Patent
Matsuhashi

(10) Patent No.: US 8,430,501 B2
(45) Date of Patent: Apr. 30, 2013

(54) LIQUID EJECTION DEVICE

(75) Inventor: Kunihiko Matsuhashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 226 days.

(21) Appl. No.: 13/005,903

(22) Filed: Jan. 13, 2011

(65) Prior Publication Data

US 2011/0169891 A1 Jul. 14, 2011

(30) Foreign Application Priority Data

Jan. 14, 2010 (JP) ..... 2010-005654

(51) Int. Cl.
*B41J 2/165* (2006.01)

(52) U.S. Cl.
USPC ..... 347/102

(58) Field of Classification Search ..... None
See application file for complete search history.

(56) References Cited

U.S. PATENT DOCUMENTS

2006/0284953 A1 12/2006 Hatasa et al.
2009/0091605 A1 * 4/2009 Xu et al. ..... 347/70

FOREIGN PATENT DOCUMENTS

JP 2005-014343 A 1/2005
JP 2005-035686 A 2/2005
JP 2007-022807 A 2/2007

* cited by examiner

*Primary Examiner* — Matthew Luu
*Assistant Examiner* — Alejandro Valencia
(74) *Attorney, Agent, or Firm* — Global IP Counselors, LLP

(57) ABSTRACT

A liquid ejection device includes a liquid ejection head that ejects a liquid to a printing object, a plate-shaped member having an open portion corresponding to a printing region of the printing object with the plate-shaped member being disposed between the printing object and the liquid ejection head, and a printing object retaining unit that maintains a constant distance between the liquid ejection head and the printing region by pushing the printing object toward the plate-shaped member. The liquid ejection head ejects the liquid to the printing region of the printing object pushed toward the plate-shaped member by the printing object retaining unit.

4 Claims, 2 Drawing Sheets

LIQUID EJECTION DEVICE

CROSS-REFERENCE TO RELATED APPLICATIONS

This application claims priority to Japanese Patent Application No. 2010-005654 filed on Jan. 14, 2010. The entire disclosure of Japanese Patent Application No. 2010-005654 is hereby incorporated herein by reference.

BACKGROUND

1. Technical Field

The present invention relates to a liquid ejection device capable of printing characters or images on a printing object such as a bag filled with contents.

2. Related Art

The technique described in Laid-Open Patent Publication No. 2005-14343, for example, is known as an inkjet printer for printing on a printing object which has an uneven surface.

This inkjet printer includes a belt conveyor for conveying the printing object, an inkjet head having inkjet nozzles for printing on the printing object, and a sensor for detecting the interval between the inkjet nozzles and the printing object conveyed by the belt conveyor.

The height of the belt conveyor is adjusted by rotating a height adjustment ball screw to raise or lower the height of the belt conveyor or a support frame in accordance with the interval between the printing object and the inkjet nozzles as detected by the sensor.

However, the conventional inkjet printer is configured such that the printing object is placed on the belt conveyor. Therefore, in a case in which the printing object is a bag filled with contents, problems occur in that the printing surface of the printing object is difficult to planarize (flatten), and a constant interval with the inkjet head is difficult to maintain.

SUMMARY

Therefore, an object of the several aspects of the present invention is to provide a liquid ejection device capable of easily printing on the printing region of a printing object in such cases as when the printing object is a bag filled with contents, for example.

In order to overcome the abovementioned problems and achieve the objects of the present invention, the present invention is configured as described below.

The liquid ejection device according to an aspect of the present invention includes a liquid ejection head that ejects a liquid onto a printing object, a plate-shaped member having an open portion corresponding to a printing region of the printing object, the plate-shaped member being disposed between the printing object and the liquid ejection head, and a printing object retaining unit that maintains a constant distance between the liquid ejection head and the printing region by pushing the printing object toward the plate-shaped member. The liquid ejection head is configured to eject the liquid to the printing region of the printing object pushed toward the plate-shaped member by the printing object retaining unit.

According to the aspect described above, in a case in which the printing region of the printing object is difficult to flatten, such as in a case in which the printing object is a bag filled with contents, for example, the printing region can be flattened, and the desired printing can be applied to the flattened printing region.

The liquid ejection device described above may further includes a conveyance unit that conveys the printing object pushed toward the plate-shaped member by the printing object retaining unit, and a suction unit that suctions the open portion of the plate-shaped member from a direction opposite the printing object before the printing object is conveyed by the conveyance unit to a position facing the liquid ejection head.

According to the aspect described above, the suction unit can attract the printing object to the plate-shaped member.

In the liquid ejection device described above, the plate-shaped member may include a plurality of through-holes on a periphery of the open portion.

According to the aspect described above, when the suction unit attracts the printing object to the plate-shaped member, the printing region of the printing object can be reliably flattened in the open portion of the plate-shaped member.

In the liquid ejection device described above, a surface of the plate-shaped member against which the printing object is pushed may have an adhesion layer configured to adhere to the printing object.

According to the aspect described above, when the suction unit attracts the printing object to the plate-shaped member, the printing region of the printing object can be reliably flattened in the open portion of the plate-shaped member, as well as caused to adhere to the plate-shaped member.

BRIEF DESCRIPTION OF THE DRAWINGS

Referring now to the attached drawings which form a part of this original disclosure.

DETAILED DESCRIPTION OF EXEMPLARY EMBODIMENTS

Embodiments of the present invention will be described hereinafter with reference to the drawings.

Embodiment of Liquid Ejection Device

Figure 1:
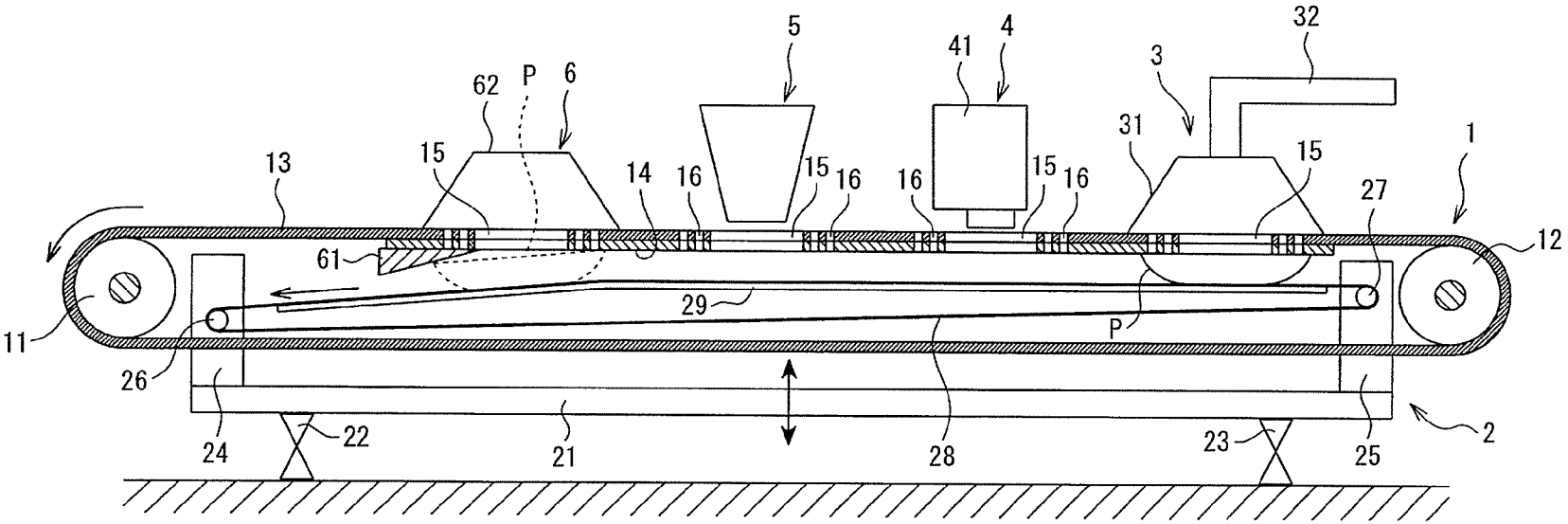
FIG. 1 is a sectional side view showing the configuration of an embodiment of the liquid ejection device of the present invention.
Figure 2:
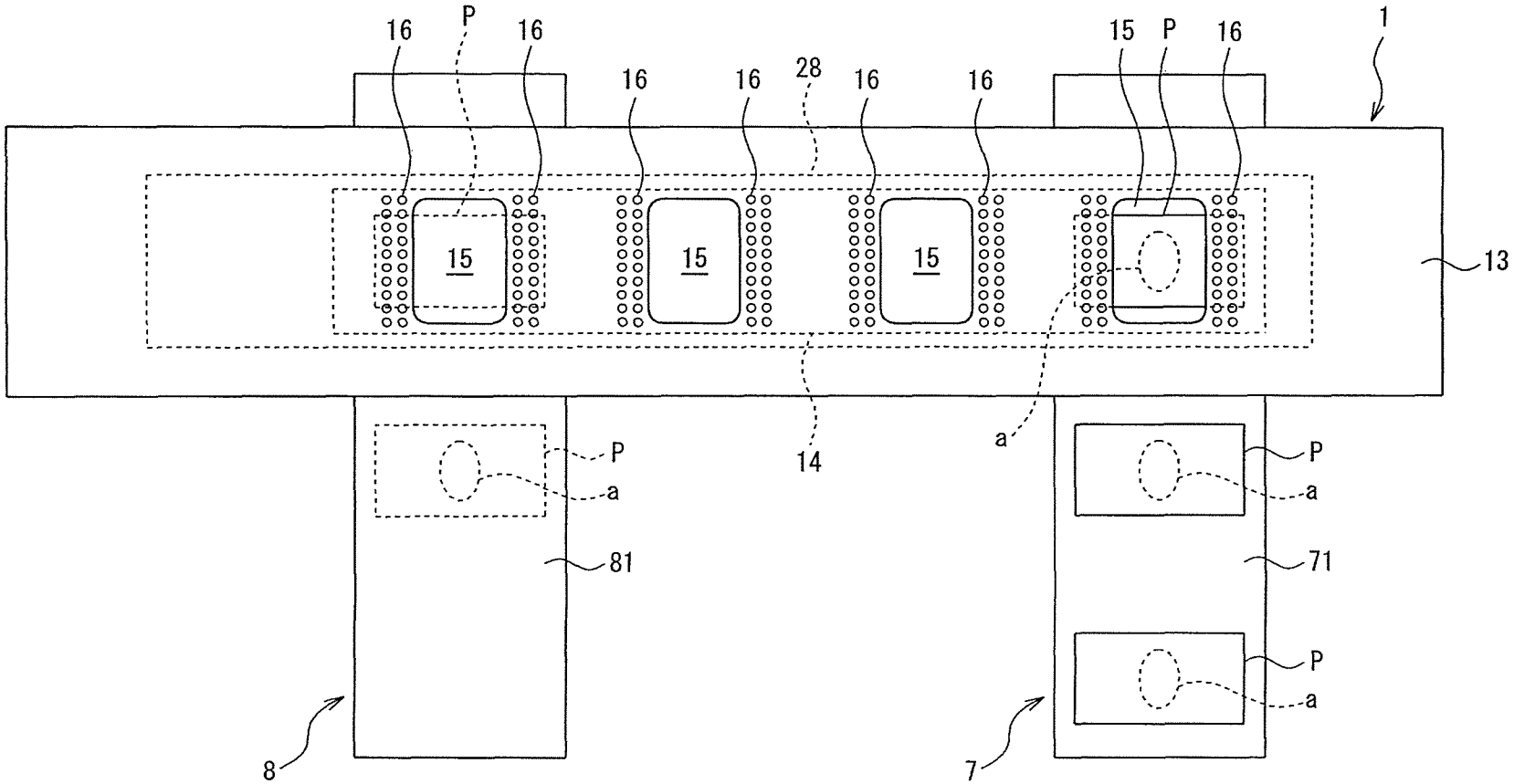
FIG. 2 is a simplified h plan view of the liquid ejection device illustrated in FIG. 1.

FIG. 1 is a sectional side view showing the configuration of an embodiment of the liquid ejection device of the present invention; and FIG. 2 is a rough plan view of FIG. 1.

This embodiment is composed of an inkjet printer, and as shown in FIGS. 1 and 2, is provided with a conveyance device 1, a printing object retaining device 2, a suction device 3, a printing device 4, a drying device 5, and a blowing/separation device 6, and is configured so that a printing object P is fed from a feeding device 7 to the printing object retaining device 2, and the printing object P for which printing is completed is delivered by a delivery device 8 from the blowing/separation device 6.

The conveyance device 1 conveys the printing object P, and is provided with a drive roller 11, a driven roller 12, and an endless conveyance belt 13 wrapped around the drive roller 11 and the driven roller 12. The conveyance belt 13 conveys the printing object P, and is configured so as to be caused to rotate in the direction of the arrow in the drawing by the driving of the drive roller 11.

An attachment member 14 which is a plate-shaped member oriented in the length direction of the conveyance belt 13 is affixed to a portion of the inside surface of the conveyance belt 13, the portion not including the end portions in the width direction of the inside surface of the conveyance belt 13 (see FIG. 2).

It is sufficient insofar as the attachment member 14 is a plate-shaped member having a predetermined thickness, and the attachment member 14 may be a member in the form of a sheet or the like having a predetermined thickness. The attachment member 14 has an adhesion layer (not shown) capable of bonding the printing object P to the opposite surface of the attachment member 14 which faces the conveyance belt 13, and from which the printing object can be separated after adhesion.

Open portions 15 (numbering four, for example) extending vertically through the conveyance belt 13 and the attachment member 14 are formed in the conveyance belt 13 and the attachment member 14 at a predetermined interval in the length direction of the conveyance belt 13. The open portions 15 correspond to the printing region a of each printing object P, and the open area thereof is larger than the surface area of each printing region a (see FIG. 2).

Numerous suction holes (through-holes) 16 extending vertically through the conveyance belt 13 and the attachment member 14 are formed on the periphery of the open portions 15 of the conveyance belt 13 and the attachment member 14. The suction holes 16 are used to attract the printing object P to the attachment member 14. In this example, a plurality of suction holes 16 is formed on either side of each open portion 15, in positions aligned with the conveyance direction of the printing object P.

The printing object retaining device 2 retains the printing object P by pushing the printing object P against the conveyance belt 13 and the attachment member 14, and is provided with a plate-shaped horizontal frame 21 disposed on the underside of the conveyance belt 13, and a pair of vertical movement mechanisms 22, 23 capable of moving and positioning the horizontal frame 21 in the vertical direction. A first vertical frame 24, a second vertical frame 25, a drive roller 26, a driven roller 27, an endless pressing belt 28, and other components are mounted on the horizontal frame 21.

The first vertical frame 24 forms a pair, and is fixed at one end on the horizontal frame 21 in a position facing the conveyance belt 13 on either side thereof. The pair of first vertical frames 24 is configured so as to support the drive roller 26 on the inside of the conveyance belt 13 so that the drive roller 26 is able to rotate.

The second vertical frame 25 forms a pair, and is fixed at the other end on the horizontal frame 21 in a position facing the conveyance belt 13 on either side thereof. The pair of second vertical frames 25 is configured so as to support the driven roller 27 on the inside of the conveyance belt 13 so that the driven roller 27 is able to rotate.

The pressing belt 28 pushes the printing object against the attachment member 14, and is wrapped around the drive roller 26 and driven roller 27 and disposed on the inside of the conveyance belt 13. The pressing belt 28 is configured so as to be rotated in the direction of the arrow in the drawing by the driving of the drive roller 26.

A support member 29 for supporting the pressing belt 28 from the inside is disposed on the inside of the pressing belt 28. The support member 29 has a horizontal portion and an inclined portion which is inclined downward and continuous with the horizontal portion. The pressing belt 28 therefore has a horizontal portion and an inclined portion which correspond to the horizontal portion and inclined portion of the support member 29.

The suction device 3, printing device 4, drying device 5, and blowing/separation device 6 are arranged in the stated order at a predetermined interval above the conveyance belt 13 of the conveyance device 1.

The suction device 3 attracts the printing object P to the attachment member 14 when the printing object P on a feeding conveyor 71 of the feeding device 7 is transported to a predetermined position on the pressing belt 28. The suction device 3 therefore has a suction cover 31 for covering a portion of the conveyance belt 13. The suction cover 31 is connected to a suction pump (not shown) via a suction pipe 32 in order to create a negative pressure inside the suction cover 31.

The printing device 4 prints characters, images, or the like in the printing region a of the printing object P, and is provided with a liquid ejection head for ejecting a liquid to the printing object P. Specifically, the printing device 4 is provided with a discharge head 41 or the like for forming characters or images by discharging (ejecting) ink to the printing region of the printing object P.

The drying device 5 dries the ink which has been discharged onto the printing region a of the printing object P, and has a halogen lamp or other heat source (not shown), and an air blower (not shown) for blowing the heat from the heat source toward the printing region of the printing object P, for example.

The blowing/separation device 6 peels the printing object P from the attachment member 14 and transfers the printing object P onto a delivery conveyor 81 of the delivery device 8. In order to accomplish this operation, the blowing/separation device 6 is provided with a picker 61 for peeling the printing object P from the attachment member 14, and an air blower (not shown) for blowing on the printing object P during peeling, and the air blower is covered by a cover 62.

An example of the operation of the embodiment configured as described above will next be described with reference to FIGS. 1 and 2.

In this operation example, a case will be described in which the printing object P is a bag filled with contents, in which the printing region of the printing object is difficult to flatten.

The pressing belt 28 of the printing object retaining device 2 at this time is in a standby state at a position below the position thereof shown in FIG. 1. In this state, when the printing object P on the feeding conveyor 71 of the feeding device 7 is transferred to a predetermined position on the pressing belt 28, raising of the pressing belt 28 is initiated by the driving of the vertical movement mechanisms 22, 23, and raising is subsequently stopped.

The top surface of the bag as the printing object P is pressed against the attachment member 14 by the raising of the pressing belt 28. At this time, since the suction device 3 simultaneously applies suction, the print surface side of the bag as the printing object P is suctioned by the open portion 15 and the numerous suction holes 16, and the print surface side of the bag is bonded to the pressure-sensitive adhesive layer of the attachment member 14.

As a result, the print surface side of the bag as the printing object P is bonded to the pressure-sensitive adhesive layer of the attachment member 14, the printing region a of the print surface side is positioned in the open portion 15, and the printing region a is flattened (see FIGS. 1 and 2).

In this state, rotation of the conveyance belt 13 and the pressing belt 28 is started at the same time. The bag as the printing object P is thereby conveyed in a state in which the surface thereof opposite the print surface is retained by the pressing belt 28.

When the printing region a of the printing object P reaches the printing device 4, ink droplets are discharged from the ink discharge head 41 to the printing region a of the printing object P. Since the printing region a of the printing object P is flattened at this time, a constant distance is maintained between the ink discharge head 41 and the printing region a. Printing on the printing region a by the ink discharge head 41 can therefore be performed with good precision.

When the printing object P subsequently reaches the drying device 5, the ink droplets discharged in the printing region a are dried.

The printing object P for which drying is completed then reaches the blowing/separation device 6 at which the conveyance belt 13 is inclined, whereupon the blowing/separation device 6 peels the printing object P from the attachment member 14 and transfers the printing object P onto the delivery conveyor 81 of the discharge device 8.

At this time, air is blown onto the printing object P by an air blower not shown in the drawings, the picker 61 peels the printing object P from the attachment member 14, and the printing object P is delivered onto the delivery conveyor 81 of the discharge device 8.

As described above, through the present embodiment, in a case in which the printing region a of the printing object P is difficult to flatten, such as in a case in which the printing object P is a bag filled with contents, for example, the printing region a can be flattened, and printing can easily be applied to the flattened printing region a.

Through the present embodiment, when the suction device 3 attracts the printing object P to the attachment member 14, the printing region a of the printing object P can be reliably flattened in the open portion 15 of the attachment member, as well as caused to adhere to the attachment member 14.

OTHER EMBODIMENTS (1) The printing device 4 is provided with an ink discharge head 41 in the embodiment described above, but the ink discharge head 41 may also be a type of ink discharge head which prints while moving in a reciprocating fashion in a secondary scanning direction orthogonal to the conveyance direction of the conveyance belt 13, or a type of ink discharge head which prints once without reciprocal movement.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid ejection device comprising:

a liquid ejection head that ejects a liquid onto a printing object;

a plate-shaped member having an open portion corresponding to a printing region of the printing object, the plate-shaped member being disposed between the printing object and the liquid ejection head; and a printing object retaining unit that maintains a constant distance between the liquid ejection head and the printing region by pushing the printing object against the plate-shaped member so that the printing object is in contact with the plate-shaped member, the liquid ejection head being configured to eject the liquid to the printing region of the printing object pushed against the plate-shaped member by the printing object retaining unit.

2. The liquid ejection device according to claim 1, further comprising a conveyance unit that conveys the printing object pushed against the plate-shaped member by the printing object retaining unit, and a suction unit that suctions the open portion of the plate-shaped member from a direction opposite the printing object before the printing object is conveyed by the conveyance unit to a position facing the liquid ejection head.

3. The liquid ejection device according to claim 1, wherein the plate-shaped member includes a plurality of through-holes on a periphery of the open portion.

4. A liquid ejection device comprising:

a liquid ejection head that ejects a liquid onto a printing object;

a plate-shaped member having an open portion corresponding to a printing region of the printing object, the late-shaped member being disposed between the printing object and the liquid ejection head; and a printing object retaining unit that maintains a constant distance between the liquid ejection head and the printing region by pushing the printing object toward the plate-shaped member, the liquid ejection head being configured to eject the liquid to the printing region of the printing object pushed toward the plate-shaped member by the printing object retaining unit, a surface of the plate-shaped member against which the printing object is pushed having an adhesion layer configured to adhere to the printing object.

* * * * *